US007964814B2

(12) United States Patent
Nakase et al.

(10) Patent No.: US 7,964,814 B2
(45) Date of Patent: Jun. 21, 2011

(54) PUSH-PUSH SWITCH WITH MOVABLE TERMINAL

(75) Inventors: Yusho Nakase, Yokohama (JP); Liang Sun, Shenzhen (CN); Yong-Jia Wang, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 90 days.

(21) Appl. No.: 12/482,493

(22) Filed: Jun. 11, 2009

(65) Prior Publication Data

US 2009/0308724 A1 Dec. 17, 2009

(30) Foreign Application Priority Data

Jun. 11, 2008 (CN) ..... 2008 2 0038113

(51) Int. Cl.
*H01H 13/70* (2006.01)

(52) U.S. Cl. ..... 200/345

(58) Field of Classification Search ..... 200/345, 200/302.2, 531, 260, 406, 517, 551, 61.76
See application file for complete search history.

(56) References Cited

U.S. PATENT DOCUMENTS

| | | | | |
|---|---|---|---|---|
| 5,008,505 | A * | 4/1991 | Takano et al. | 200/531 |
| 6,180,903 | B1 * | 1/2001 | Chen | 200/406 |
| 2007/0051602 | A1 * | 3/2007 | Tan | 200/302.2 |

* cited by examiner

*Primary Examiner* — Edwin A. Leon
(74) *Attorney, Agent, or Firm* — Wei Te Chung; Andrew C. Cheng; Ming Chieh Chang

(57) ABSTRACT

A push-push switch includes a housing having a space, a plurality of stationary terminals received in the housing, a button assembled to the housing, a movable terminal assembled to the button, and a spring member located between the housing and the button. The space has a first post defining a protrusion thereon. The stationary terminal defines a contacting portion extending onto a surface of the first post and a soldering portion extending out of the housing. The movable terminal further defines a downwardly-extending contact arm and a downwardly-extending felt-generated spring arm extending from a planar base portion thereof while at different positions. The contact arm is established electrically connection with the contacting portion of the stationary terminal when the button is depressed, and the felt-generated spring arm is engaged with the protrusion of the first post in the meantime.

13 Claims, 9 Drawing Sheets

PUSH-PUSH SWITCH WITH MOVABLE TERMINAL

BACKGROUND OF THE INVENTION

1. Field of the Invention

The present invention relates to a push-push switch, and more particularly to a push-push switch with a movable terminal having a contact arm and a felt-generated spring arm.

2. Description of Related Art

FIGS. 1-4 disclose a commonly push-push switch 100', and which comprises an insulative housing 20' having a space 10', a plurality of stationary terminals 30' received in the housing 20', a metallic member 40' received in the space 10', a spring member 50' located above the metallic member 40', a movable terminal 60' located above the spring member 50', a button 70' assembled to the housing 20' and a cover 80' firmly engaged with the button 70'. The space 10' of the housing 20' is formed with a bottom wall 21' and a number of sidewalls 22'. A first post 23' extends from the bottom wall 21' and located in the space 10'. Said stationary terminal 30' comprises a contacting portion 31' disposed onto a surface of the first post 23' and a soldering portion 32' extending out of the insulative housing 20'. The metallic member 40' defines a body portion 41' surround the first post 23' and a spring portion 42' extending upwardly from the body portion 41'. The movable terminal 60' defines a base portion 61' having a mounting hole 611', and a contact arm 62' extending downwardly from the base portion 61' and corresponding with the contacting portion 31'. The button 70' defines an upper wall 74' and a plurality of sidewalls 73' extending downwardly from the upper wall 74', the button 70 further defines a second post 71' through the mounting hole 611' of the movable terminal 60' and received in the first post 23' when the push-push switch 100' is completely assembled. The sidewall 73' of the button 70' defines a protrusion 72' corresponding with the spring portion 42' of the metallic member 40'. The spring member 50' provides elastic-restoring force for the button 70'. When the push-push switch 100' is at an original state, the contacting portion 31' of the stationary terminal 30' and the contact arm 62' of the movable terminal 60' are defined at different positions. In used, the contact arm 62' is established electrically connection with the contacting portion 31' of the stationary terminal 30' when the button 70' is depressed, and at the same time, the protrusion 72' of the button 70' engages with the spring portion 41' of the metallic member 40' creating a felt indicating the effective stroke of the button 70' has traveled.

However, the push-push switch 100' utilizes the metallic member 40' for providing hand feeling only. The design above-mentioned will result in the increase in costs. Hence, an improved push-push switch is required to overcome the disadvantages of the prior art.

SUMMARY OF THE INVENTION

Accordingly, an object of the present invention is to provide a push-push switch with a movable terminal having a contact arm established electrically connection and a felt-generated spring arm creating a felt indicating an effective stroke of a button is traveled.

In order to achieve the above-mentioned object, a push-push switch comprises a housing having a space, a plurality of stationary terminals received in the housing, a button assembled to the housing, a movable terminal assembled to the button, and a spring member located between the button and the button. The space has a first post defining a protrusion thereon. The stationary terminal defines a contacting portion extending onto a surface of the first post and a soldering portion extending out of the housing. The button defines a second post extending into the first post when the push-push switch is completely assembled. The movable terminal defines a base portion having a mounting hole around the second post for assembling the movable terminal on the button. The movable terminal further defines a downwardly-extending contact arm and a downwardly-extending felt-generated spring arm. Said contact arm is established electrically connection with the contacting portion of the stationary terminal when the button is depressed, and said felt-generated spring arm is engaging with the protrusion of the first post in the meantime.

In the embodiment of the present invention, we have a new design about the movable terminal simultaneously has the contact arm for establishing electrically connection and the felt-generated spring arm for hand feeling. With the design above-mentioned, the push-push switch will reduce working procedure in assembly and save the cost.

Other objects, advantages and novel features of the present invention will become more apparent from the following detailed description of the present embodiment when taken in conjunction with the accompanying drawings.

DETAILED DESCRIPTION OF THE INVENTION

Figure 1:
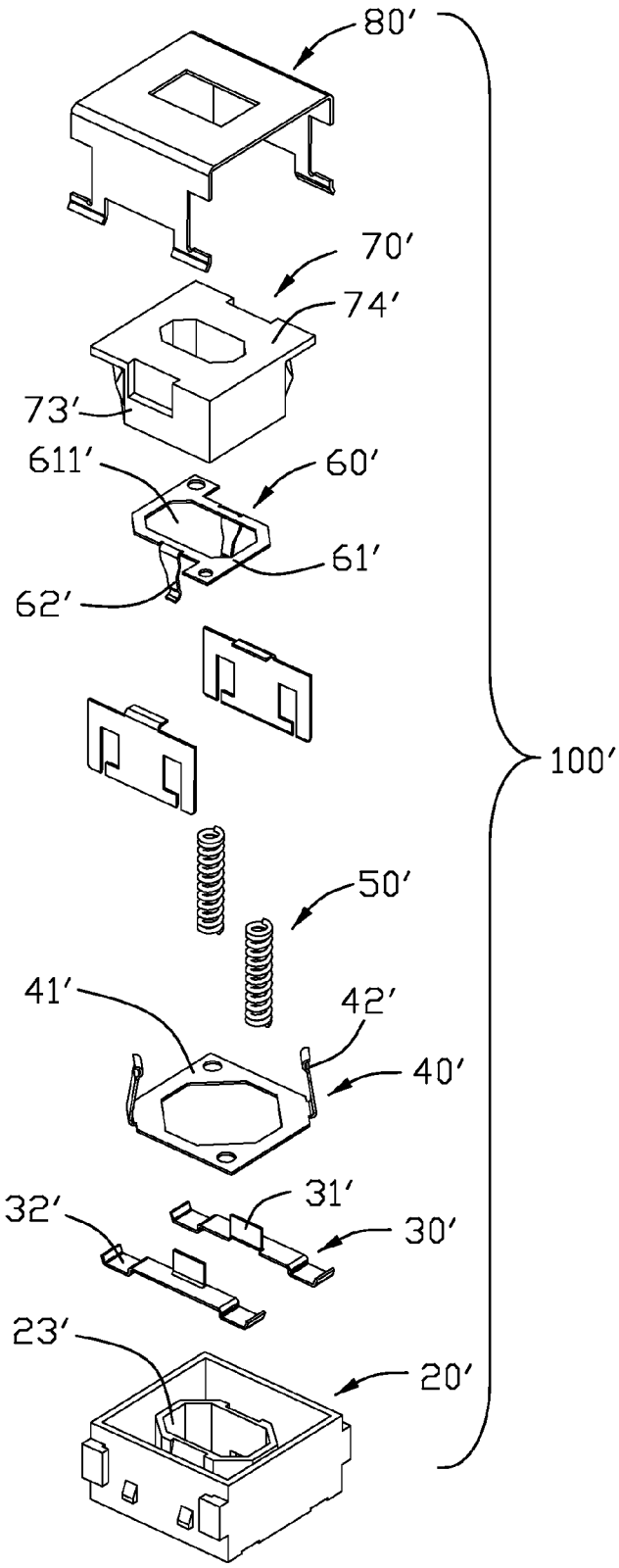
FIG. 1 (PRIOR ART)
FIG. 1 is an exploded, perspective view of a push-push switch in the prior art.
Figure 2:
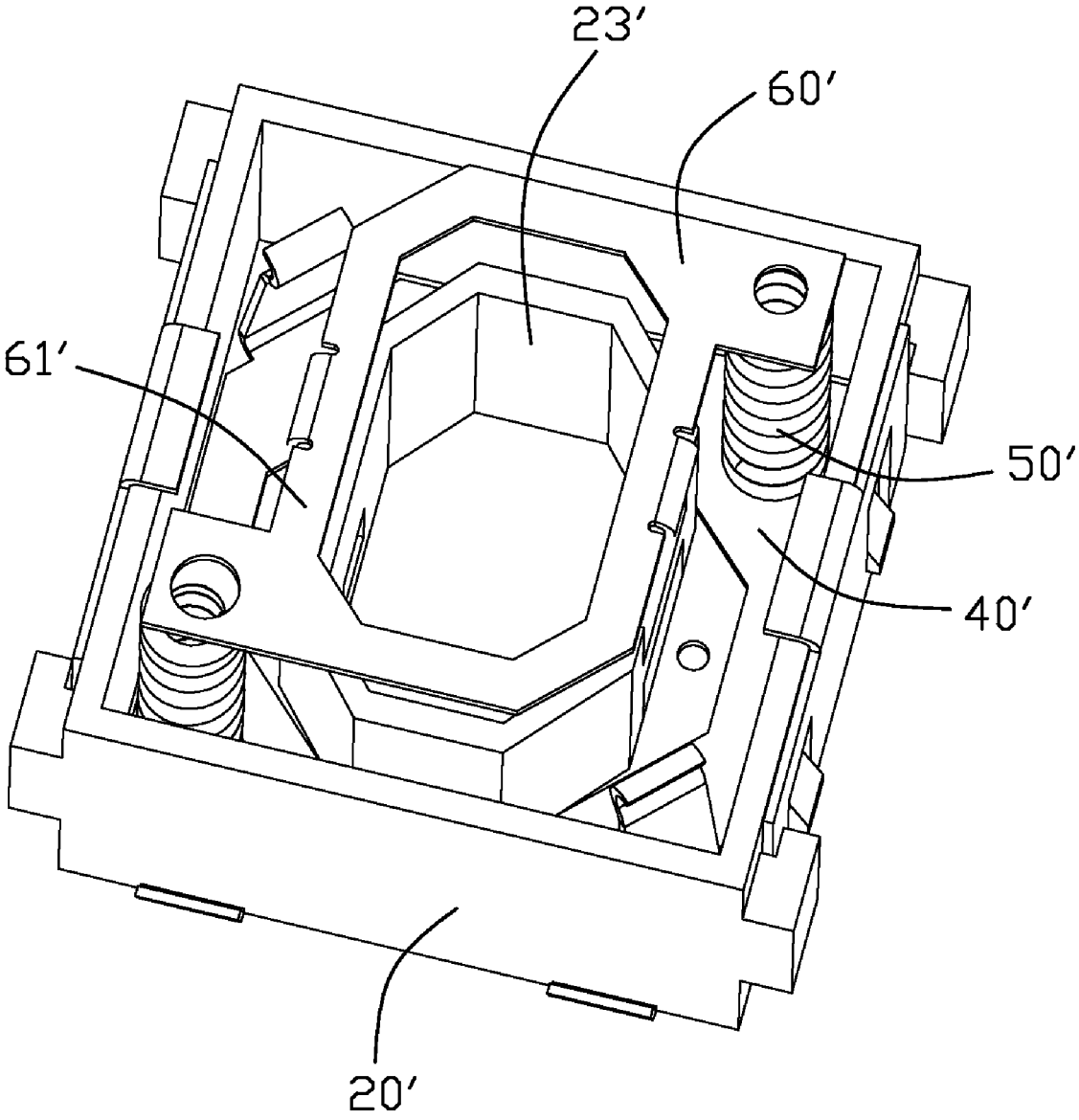
FIG. 2 (PRIOR ART)
FIG. 2 is an assembled, perspective view of the push-push switch which take the cover and the button out.
Figure 3:
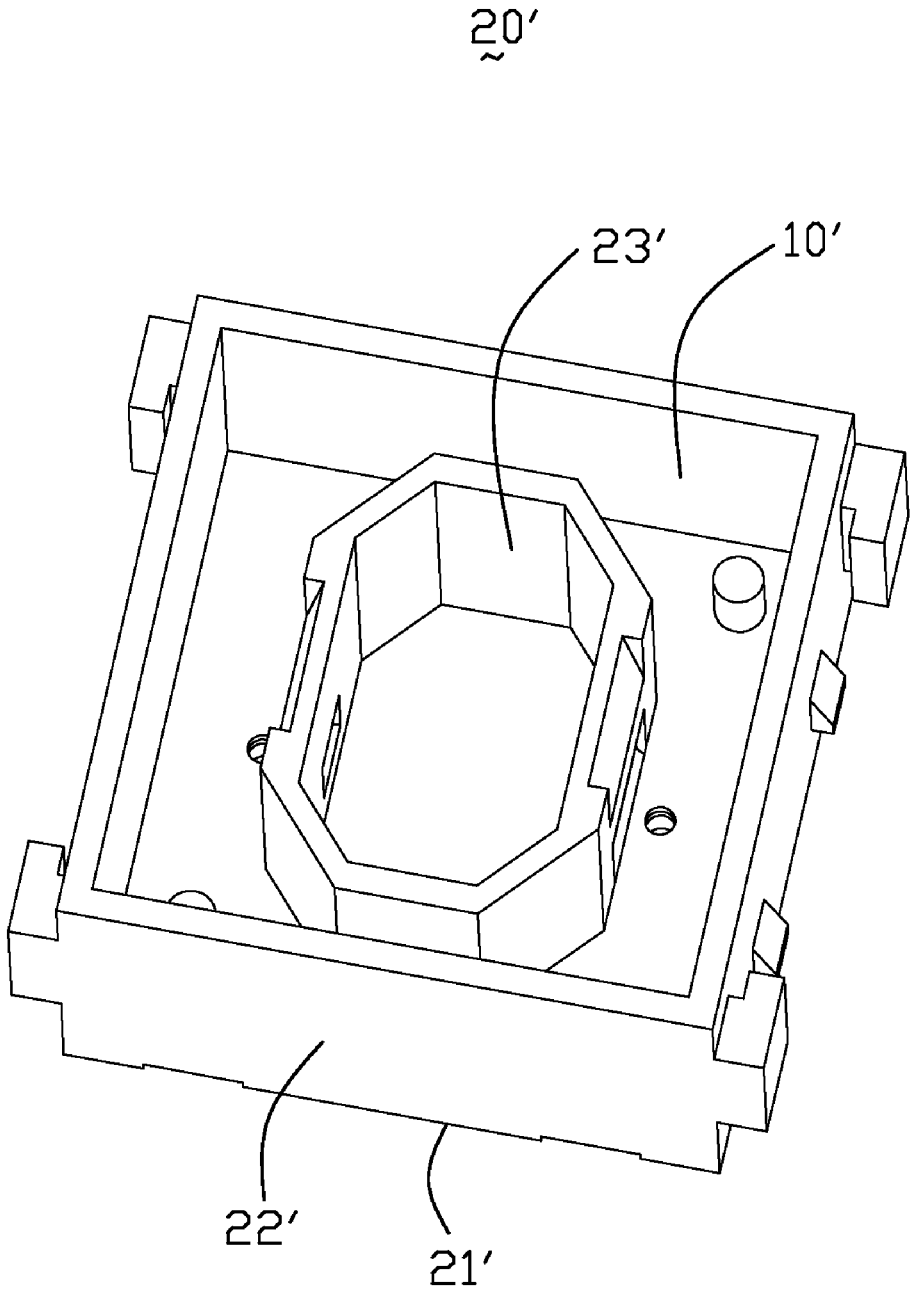
FIG. 3 (PRIOR ART)
FIG. 3 is perspective view of the housing of FIG. 1.
Figure 4:
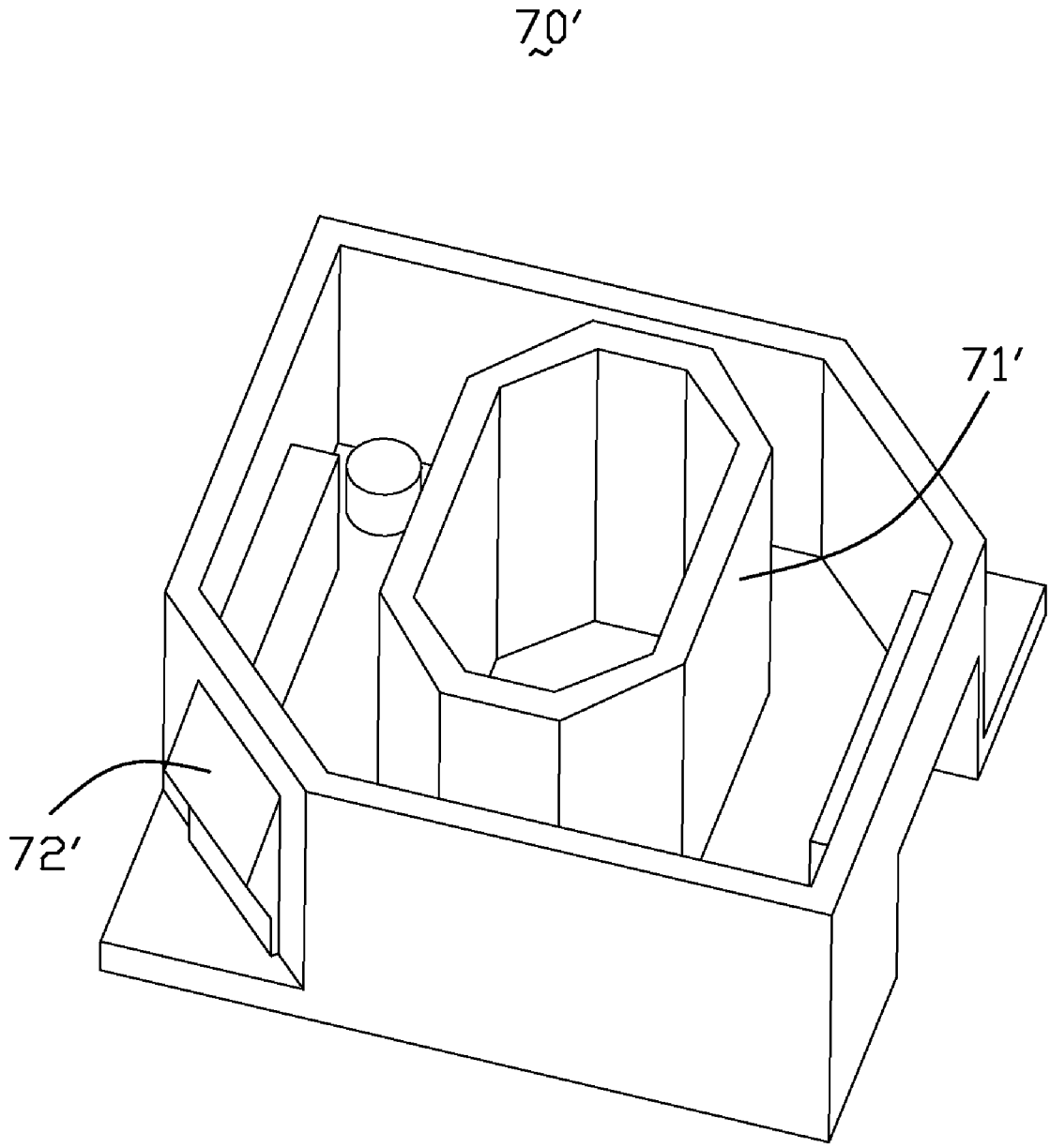
FIG. 4 (PRIOR ART)
FIG. 4 is perspective view of the button of FIG. 2.
Figure 5:
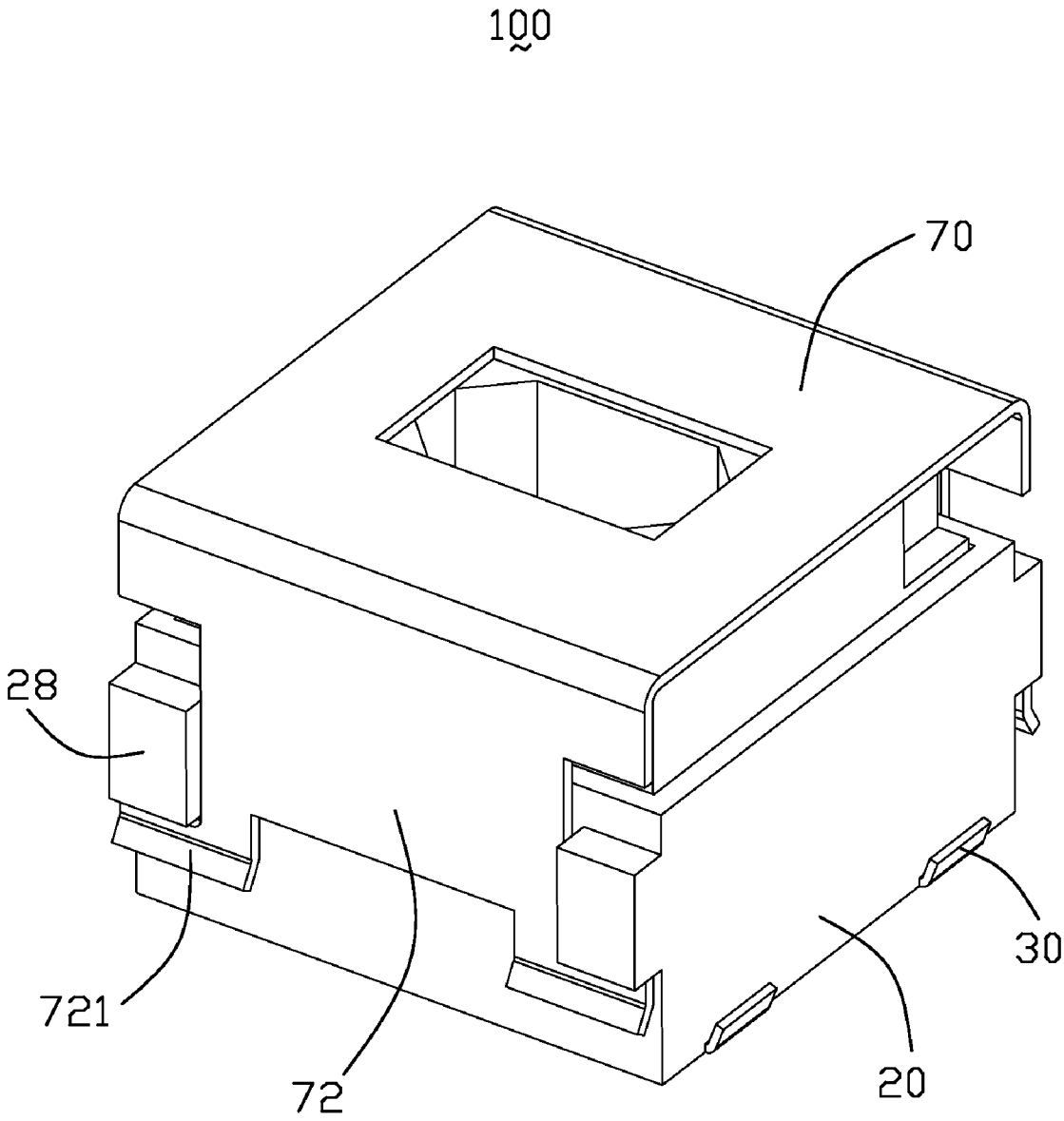
FIG. 5 is an assembled, perspective view of a push-push switch according to an embodiment of the present invention.
Figure 6:
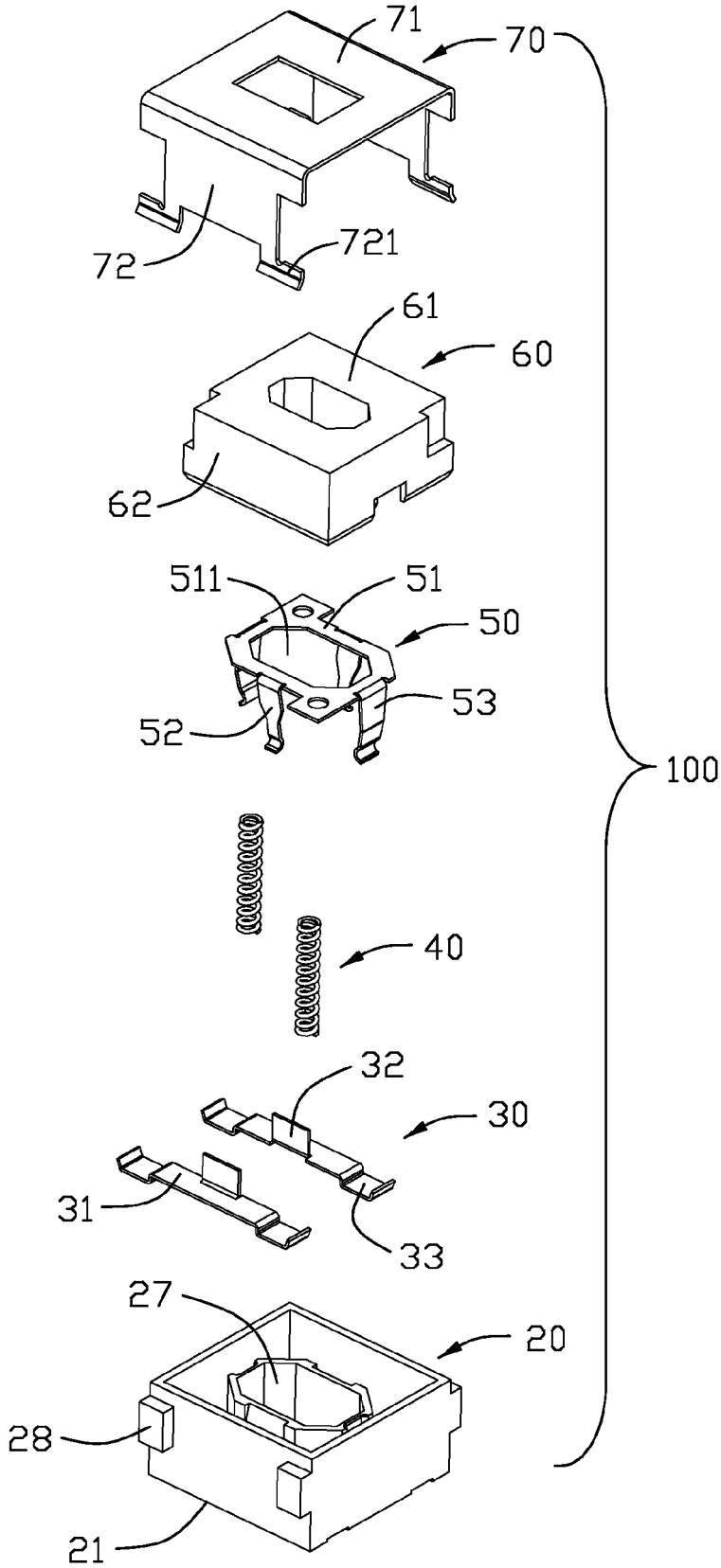
FIG. 6 is an exploded, perspective view of the push-push switch of FIG. 5.
Figure 7:
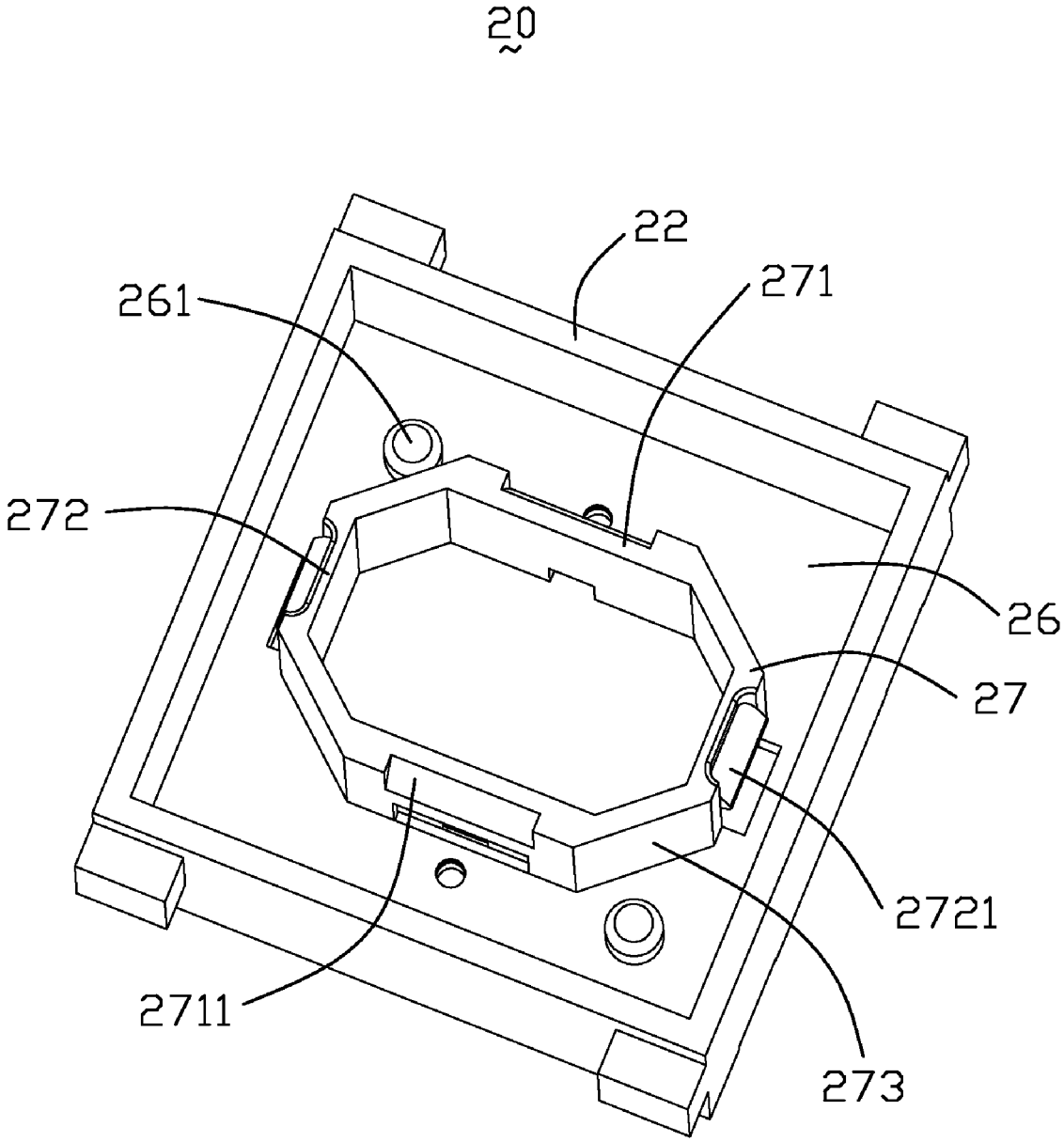
FIG. 7 is perspective view of the housing of FIG. 6.

Referring to FIGS. 5 to 9, a push-push switch 100 comprises an insulative housing 20, a pair of stationary terminals 30 received in the housing 20, a button 60 assembled in the housing 20, a movable assembled 50 in the button 60, a spring member 40 located between the button 60 and the housing 20, and a cover 70 firmly engaged with the button 60.

The insulative housing 20 is a rectangle, and comprises a bottom wall 21, a plurality of sidewalls 22 extending upwardly from the bottom wall 21. The bottom wall 21 and the sidewalls 22 cooperatively define a first space 26. The first space 26 has a first post 27 extending upwardly from a middle position of the bottom wall 21. Said first post 27 is a hollow frame with eight surfaces, and comprises a pair of first surfaces 271 parallel with one of the sidewalls 22 of housing 20, a pair of second surfaces 272 perpendicular with the first surfaces 271, and a number of third surfaces 273 connecting the first surfaces 271 and the second surfaces 272 respectively. The first surface 271 defines a lead section 2711 at top end thereof; the second surface 272 defines a protrusion 2721 at middle position thereof. A pair of first fixing posts 261 is respectively defined at a diagonal corner of the bottom wall 21 of the housing 20. In addition, a number of tubers 28 are defined on outside face of the sidewalls 22.

The stationary terminals 30 are disposed symmetrically with respect to a central axis of the first post 27, the stationary terminal 30 defines a body portion 31 embedded in the bottom wall 21 of the housing 20, a contacting portion 32 extending onto the first surface 271 of the first post 27, and a soldering portion 33 extending out of the housing 20.

The spring member 40 is located between the button 60 and the housing 20 for providing elastic-restoring force and therefore the length of the spring member 40 is longer than the sidewall 22 of the housing 20 and the first post 27.

The button 60 is a hollow rectangle with an facing downward, and comprises a top wall 61 and a plurality of sidewalls 62 extending downwardly from the top wall 61; the top wall 61 and the sidewalls 62 cooperatively define a second space 63. The space 63 has a second post 64 extending into the first post 27 of the housing 20 when the push-push switch 100 is completely assembled. Said second post 64 is also a hollow frame with eight surfaces. In addition, the top wall 61 defines a second fixing post (not label, referring to FIG. 9, which fixing the spring member 40) corresponding with the first fixing post 261 of the housing 20. The second fixing post All the fixing posts 261 are aligned in a vertical line and used for fixing the spring member 40.

Figure 8:
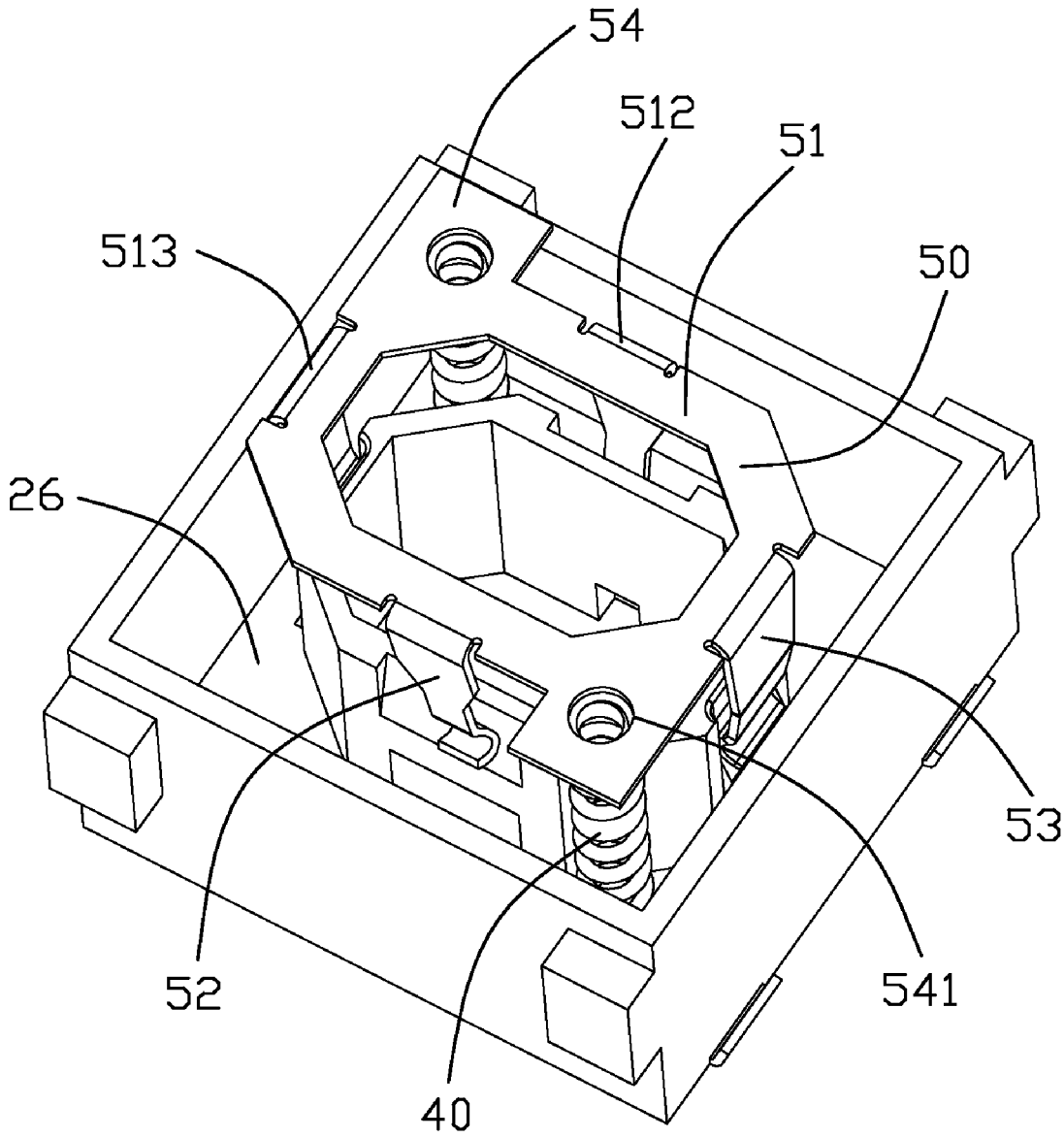
FIG. 8 is an assembled, perspective view of the push-push switch which take the button and the cover out.
Figure 9:
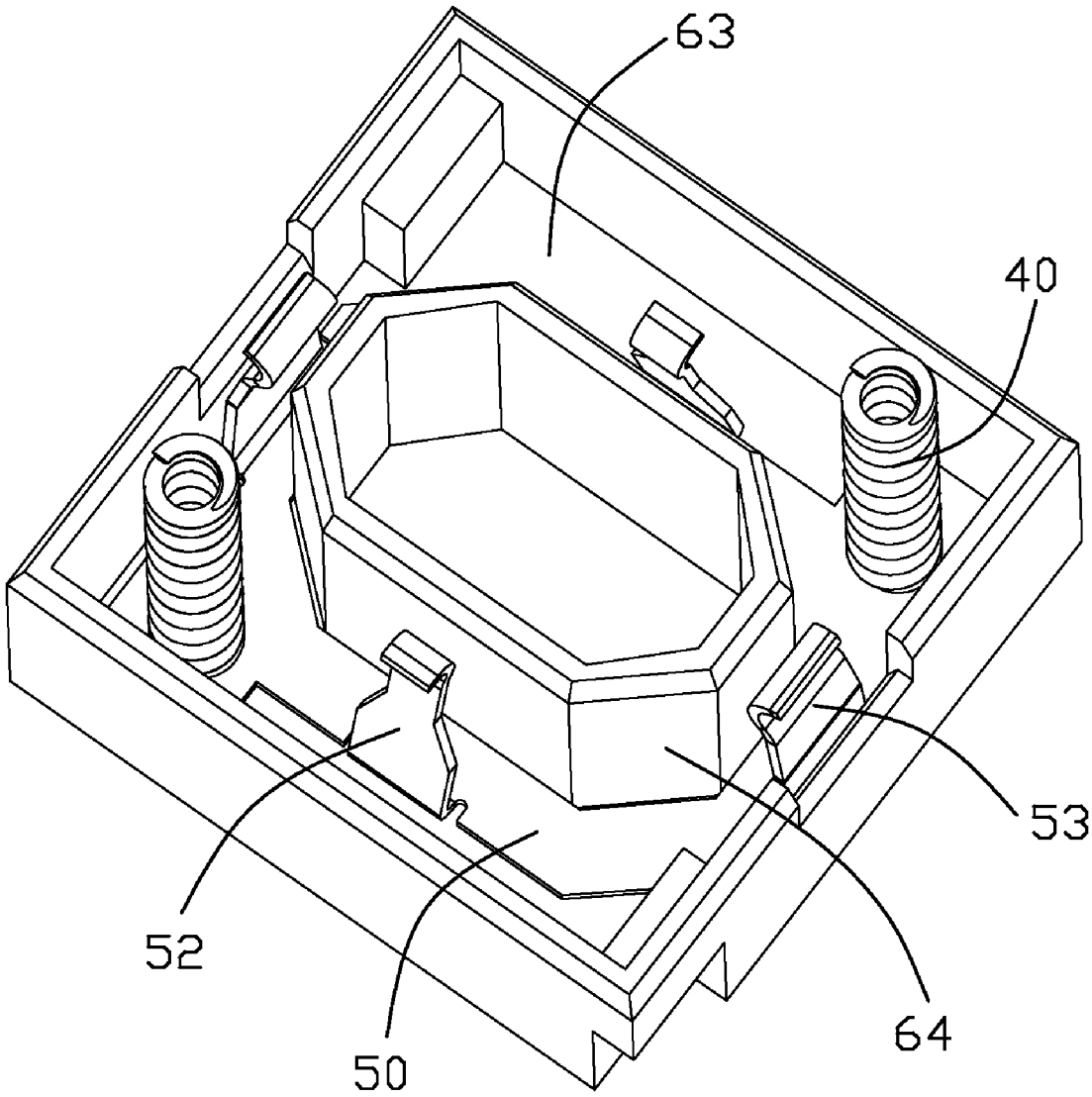
FIG. 9 is an assembled, perspective view of the button with the movable and the spring member.

The movable terminal 50 defines a base portion 51 having a mounting hole 511 around the second post 64 of the button 60 for assembling the movable terminal 50 on the button 60. Referring to FIG. 8, the base portion 51 defines a pair of first edges 512 parallel with the first surfaces 271 of the first post 27 and a pair of second edges 513 parallel with the second surfaces 272 of the first post 27. The movable terminal 50 further defines a pair of contact arms 52 extending downwardly from the first edge 512 of the base portion 51 respectively and a pair of felt-generated spring arm 53 extending downwardly from the second edge 513 of the base portion 51 respectively. All free ends of the contact arms 52 and the felt-generated spring arms 53 are formed in "d" configuration. In addition, the base portion 51 defines a pair of ear portions 54 respectively having hole 541 around the second fixing post of button 60.

The cover 70 comprises an upper wall 71 with a rectangle, and a pair of plates 72 extending downwardly from the opposite end of the upper wall 71. The plate 72 defines a locking bard 721 at lower end thereof and corresponding with the tuber 28 of the housing 20.

When assembling, the stationary terminal 30 is received in the housing 20 first, the movable terminal 50 is assembled in the button 60 and then the end of the spring member 40 surrounds the second post 64 of the button 60. The button 60 with movable terminal 40 and the spring member 40 are assembled in the housing 20 from the top down, the second post 64 of the button 60 is received in the first post 27 of the housing 20, and the other end of the spring member 40 around the first post 27 of the housing 20 for making the spring member 40 firmly. At the same time, the felt-generated spring arm 53 of the movable terminal 50 has a contact with top end of the protrusion 2721 of the first post 27 of the housing 20 and the contact arm 52 of the movable terminal 50 also has a contact with the lead section 2711 of the first post 27 of the housing 20. At the last, the cover 70 is assembled on the button 60.

When used, the spring member 40 contracts as the button 60 received an external force. Said contact arm 52 is established electrically connection with the contacting portion 32 of the stationary terminal 30 when the button 60 is depressed, and said felt-generated spring arm 53 engaging with the protrusion 2721 of the first post 27 in the meantime.

In the embodiment of the present invention, we disclose a new design about the movable terminal 50 unitarily having the opposite contact arms 52 adapted to electrically engage with the respective contacting portions 32 of the stationary terminals 30 and at least one felt-generated spring arm 53 different from the contact arms 52. Downward movement of the movable terminal 50 relative to the stationary terminals 30 causes the contact arms 52 of the movable terminal 50 in electrical contact with the contacting portions 32 of the stationary terminals 30 under a condition that the felt-generated spring arm 53 goes across the protrusion 2721 of the first post 27 to generate a click feel. With the design above-mentioned, the push-push switch 100 will reduce working procedure in assembly and save the cost.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A push-push switch comprising:

an insulative housing having a bottom wall and a number of sidewalls to commonly define a receiving space, the housing having a first hollow frame extending upwardly from the bottom wall, said hollow frame defining a protrusion on a first side wall thereof;

a pair of stationary terminals disposed symmetrically with respect to a central axis of the hollow frame, the stationary terminals having contacting portions respectively abutting against opposed second and third side walls of the first hollow frame, each of the stationary terminals having a soldering portion extending out of the insulative housing;

a movable terminal disposed upon the first hollow frame and being floatably movable relative to the stationary terminals along an up-to-down direction by means of spring members between the movable terminal and said bottom wall, said movable terminal unitarily having a pair of opposite downwardly-extending contact arms adapted to electrically engage with the respective contacting portions of the stationary terminals and at least one downwardly-extending felt-generated spring arm different from said contact arms; and wherein downward movement of the movable terminal relative to the stationary terminals causes said contact arms of the movable terminal in electrical contact with the contacting portions of the stationary terminals under a condition that said felt-generated spring arm goes across said protrusion of the hollow frame to generate a click feel.

2. The push-push switch as claimed in claim 1, wherein both free ends of the contact arm and the felt-generated spring arm are formed in a V-shape.

3. The push-push switch as claimed in claim 2, wherein the length of the spring member is longer than the first hollow frame of the housing at an original state.

4. The push-push switch as claimed in claim 3, wherein the push-push switch further defines a button assembled on the housing, said button defines a second hollow frame received in the first hollow frame when the push-push switch is completely assembled.

5. The push-push switch as claimed in claim 4, wherein a pair of first fixing posts is respectively defined at a diagonal corner of the bottom wall of the housing, the button defines a pair of second fixing posts corresponding with the first fixing posts respectively, all the fixing posts are used for fixing the spring member.

6. The push-push switch as claimed in claim 5, wherein the button defines a top wall and a plurality of sidewalls extending downwardly from the top wall, the second hollow frame extends downwardly from a bottom face of the top wall.

7. The push-push switch as claimed in claim 6, wherein the first hollow frame defines a lead section above the contacting portion of the stationary terminal, the contact arm of the movable terminal presses the lead section at an original state.

8. The push-push switch as claimed in claim 7, wherein the push-push switch further comprises a cover firmly engaged with the button.

9. A push-push switch comprising:

a case formed by a button and a lower housing, where said button is assembled on said lower housing, a first vertical post provided in the button and a second vertically post provided in the lower housing for receiving the first vertical post, said second vertical post defining a protrusion thereon;

a spring member received in the case for supporting the button;

a stationary terminal being insert molded in the lower housing, and comprising a contacting portion extending onto a surface of the second vertical post and a soldering portion extending out of the lower housing; and a movable terminal assembled to the first vertically post, wherein the movable terminal includes a downwardly-extending contact arm and a downwardly-extending felt-generated spring arm, said contact arm established electrically connection with the contacting portion of the stationary terminal when the button is depressed, and said felt-generated spring arm engaging with the protrusion of the second vertical post in the meantime.

10. The push-push switch as claimed in claim 9, wherein the movable terminal defines a mounting hole around the first vertical post.

11. The push-push switch as claimed in claim 10, wherein both free end of the contact arm and the felt-generated spring arm are formed in a V-shape.

12. The push-push switch as claimed in claim 11, wherein the push-push switch further comprises a cover firmly engaged with the button.

13. A push-push switch comprising:

an insulative housing equipped with a pair of stationary contacts;

a button up-and-down movably mounted upon the housing and equipped with an associated moveable contact attached thereto;

a spring device sandwiched between the housing and the button to constantly urge the button away from the housing; wherein said moveable contact unitarily defines a pair of contact arms to mechanically and electrically connect to the corresponding pair of stationary contacts, respectively, and at least one felt-generated spring arm which engages a protrusion of the housing when the button is pushed downward to have the pair of contact arms engaged with the pair of stationary contacts; wherein both said contact arms and said felt-generated spring arm extend downward from a planar base portion of said moveable contact while at different positions.

* * * * *